United States Patent [19]

De Maria

[11] 4,025,971

[45] May 31, 1977

[54] CONVERTIBLE SOFA BED

[76] Inventor: Carmine De Maria, 39 E. Madison Ave., Collingswood, N.J. 08108

[22] Filed: Nov. 11, 1975

[21] Appl. No.: 630,882

[52] U.S. Cl. ..... 5/18 R

[51] Int. Cl.[2] ..... A47C 17/06

[58] Field of Search ..... 5/28, 29, 13, 18 R, 5/21

[56] References Cited

UNITED STATES PATENTS

| | | | |
|---|---|---|---|
| 262,181 | 8/1882 | Hale | 5/18 R X |
| 949,374 | 2/1910 | Karpen | 5/18 R X |
| 2,876,463 | 3/1959 | Barath | 5/21 |
| 3,385,631 | 5/1968 | Gertler | 5/18 X |

*Primary Examiner*—Paul R. Gilliam
*Assistant Examiner*—Andrew M. Calvert
*Attorney, Agent, or Firm*—Clarence A. O'Brien; Harvey B. Jacobson

[57] ABSTRACT

A frame including upright opposite side portions having front and rear ends and an upstanding backrest is supported above side frame portions. A pair of front and rear support arms are pivotally supported from lower forward and intermediate portions of the corresponding frame side portion for swinging about horizontal transverse axes. A first seat frame is pivotally attached to corresponding support arms. A second seat frame is supported in superposed relation from and above the first seat support frame. A pair of seat cushions overlie the first and second seat frames and are positionable in superposed relation when the second seat frame is disposed in superposed relation with the first seat frame.

6 Claims, 6 Drawing Figures

CONVERTIBLE SOFA BED

BACKGROUND OF THE INVENTION

Various forms of convertible sofa beds have been heretofore designed, but most involve relatively complex supporting linkage systems for a foldable mattress supporting spring structure and require the utilization of a mattress structure in addition to the seat cushion of the sofa. Further, most conventional convertible sofa beds utilize a complex supportive linkage system for the mattress spring portion thereof which are extremely heavy and utilize counterbalance springs which tend to project the foldable portions of the convertible sofa beds toward their fully extended positions after having been at least partially opened.

Examples of various forms of convertible sofa bed and chair structures including some of the basic structural features of the instant invention are disclosed in U.S. Pat. Nos. 1,266,691, 2,328,254, 2,335,870, 2,681,691, 2,687,766, 2,878,491, 2,911,032, 3,107,366 and 3,198,576.

BRIEF DESCRIPTION OF THE INVENTION

The convertible sofa bed of the instant invention has been constructed in a manner whereby it requires a minimum of mechanical linkages and connections as well as frame members in order to convert the sofa bed from a sofa to a bed. In addition, the instant invention, because of its simplicity, represents a considerable savings in the total bulk of metal and other structural materials. The sofa bed may be readily transformed from a sofa to a bed with little effort on the part of only one person and also readily converted, by a single person, from a bed back into a sofa.

The main object of this invention is to provide a sofa bed which may be readily transformed from a sofa to a bed and back to a sofa by only one person.

Another important object of this invention is to provide a convertible sofa bed constructed in a manner whereby the total volume of metal and other structural members is maintained at a minimum.

A further object of this invention is to provide a convertible sofa bed in accordance with the preceding objects and including latch means for automatically retaining the structural portions of the invention in a bed defining position after having been moved to the bed defining position and which may be automatically released in response to partial movement of one of the bed frame supporting members toward its retracted position.

A final object of this invention to be specifically enumerated herein is to provide a convertible sofa bed construction in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of constuction and operation as more fully hereinafter described and claimed, reference being had to the accompanying drawings forming a part hereof, wherein like numerals refer to like parts throughout.

DETAILED DESCRIPTION OF THE INVENTION

Figure 4:
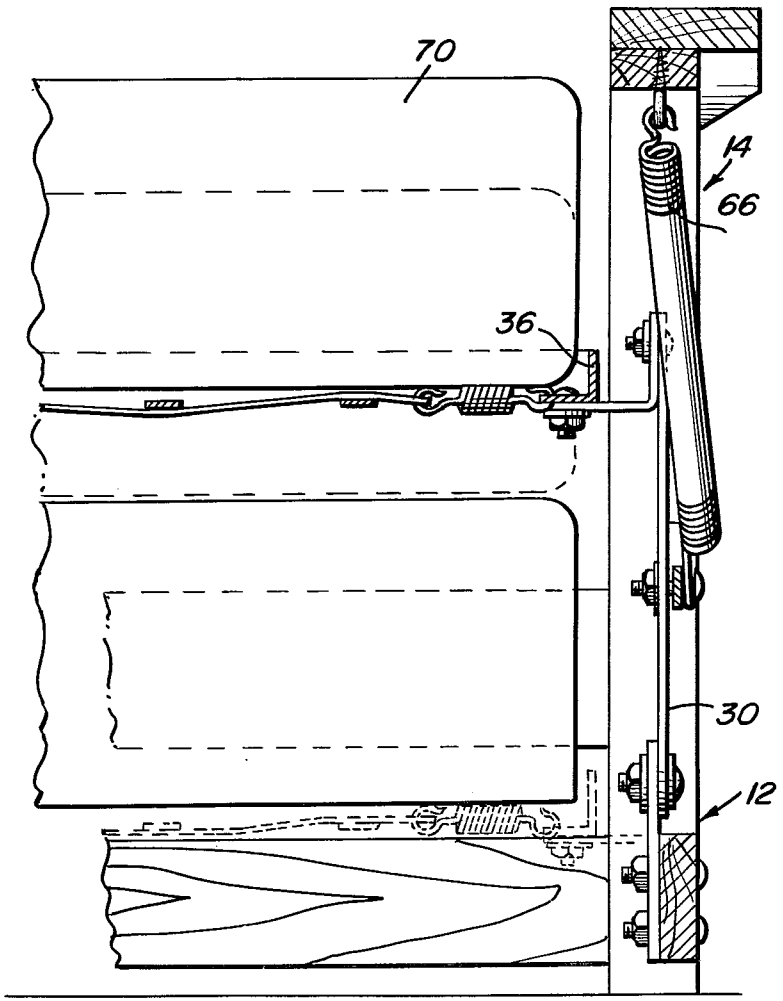
FIG. 4 is an enlarged fragmentary transverse vertical sectional view taken substantially upon a plane passing through the forward portion of the near side or end frame structure of the invention illustrated in FIG. 3.
Figure 1:
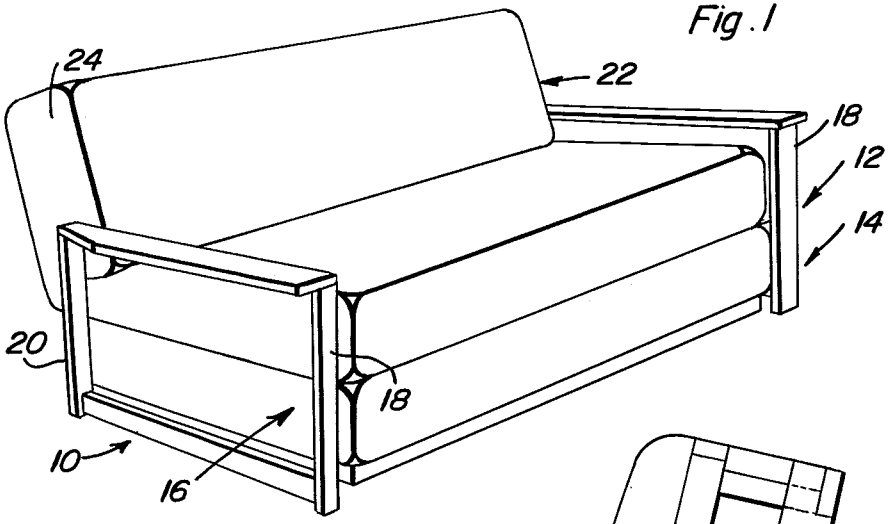
FIG. 1 is a perspective view of the invention in a sofa defining position.

Referring now more specifically to the drawings the numeral 10 generally designates the convertible sofa bed of the instant invention. The sofa bed 10 includes a frame referred to in general by the reference numeral 12 including substantially mirror image right and left side frame sections 14 and 16. The side frame portions 14 and 16 include front and rear marginal portions 18 and 20 and an upstanding backrest section 22 including a forwardly facing cushion 24 is supported between the upper portions of the rear marginal portions 20, the backrest section 22 projecting considerably above the upper marginal portions of the opposite side portions 14 and 16.

The opposite side portions 14 and 16 include lower front to rear extending members 26 and the lower ends of a pair of upright support arms 28 and 30 are pivotally supported as at 32 and 34, respectively, from intermediate and forward portions of the front to rear extending members 26. The support arms 28 and 30 are disposed in upstanding positions in FIG. 3 of the drawings and the upper ends of the support arms 28 and 30 are pivotally secured to rear and intermediate opposite side portions of a first seat cushion supporting frame 36. Accordingly, the first seat cushion supporting frame 36 is swingable from the upper position thereof illustrated in FIG. 3 of the drawings with the forward marginal portion of the frame 36 projecting considerably forwardly of the frame 12 and the lowered position illustrated in FIG. 2 with the first seat cushion supporting frame 36 disposed between the lower marginal portions of the opposite side frame portions 14 and 16.

The approximate vertical mid-portions of each pair of support arms 28 and 30 have a horizontal stabilizing link 40 pivotally secured therebetween as at 42 and 44 and each link 40 includes a mounting bracket 46 to which one end of a latching lever 48 is pivotally secured as at 50. The other end of each latching lever 48 includes a downwardly opening notch 52 and a forwardly and upwardly inclined cam tab 54. An anchor bracket 56 is secured to the forward marginal portion of each frame portion 14 and 16 and is engageable by the notched portion 52 of the corresponding latching lever 48 when the support arms 28 and 30 are in their vertical positions illustrated in FIG. 3. However, a second seat cushion supporting frame 58 is telescoped downwardly over and slidingly engaged with the frame 36 for forward extension and rearward retraction of the second seat cushion supporting frame 58 relative to the first frame 36 and opposite side portions of the second frame 58 include brackets 60 supported therefrom including abutment tongues 62 engageable with the cam tongues 54 when the second frame 58 is retracted rearwardly relative to the first frame 36. In this manner, the abutment flange or tongue 62 on each end of the frame 58 may engage the corresponding cam tongue 54 to upwardly displace the forward ends of the latching levers 48 and thereby shift the latter to their unlatched positions. Of course, when the second seat cushion supporting frame 58 is in a fully superposed position relative to the seat cushion supporting frame 36, further rearward forces applied to the frames 36 and 58 will cause the upper ends of the support arms 28 and 30 to swing rearwardly and downwardly whereby the frames 36 and 58 will be disposed in the lowered positions thereof illustrated in FIG. 2 of the drawings.

Figure 2:
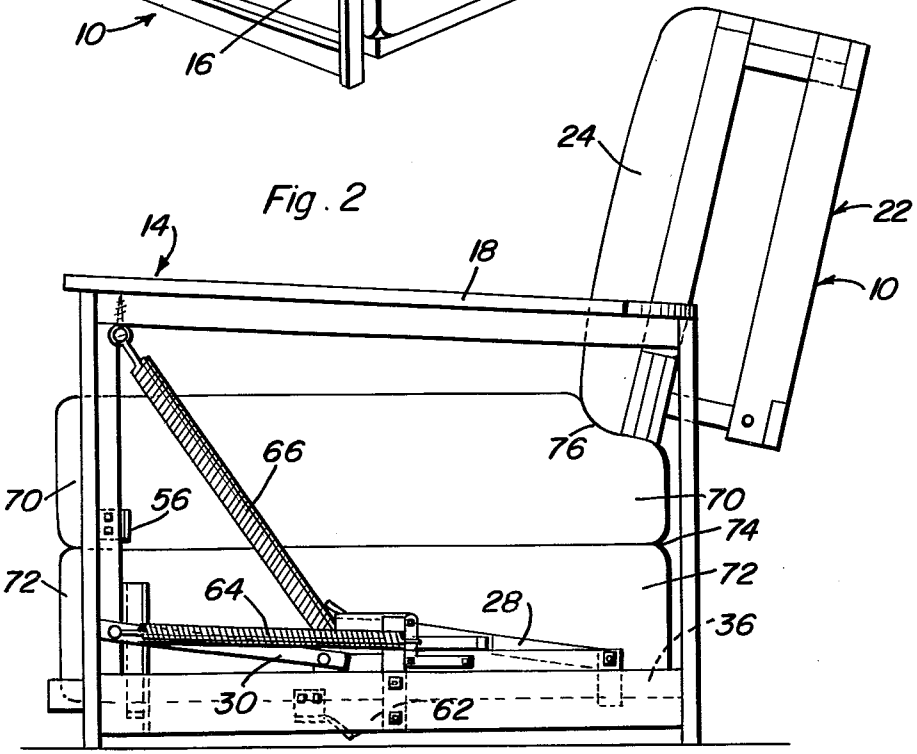
FIG. 2 is a side elevational view of the invention as seen from the right side of FIG. 1 and with the near end upholstery removed to more clearly illustrate the internal structural members of the invention.
Figure 3:
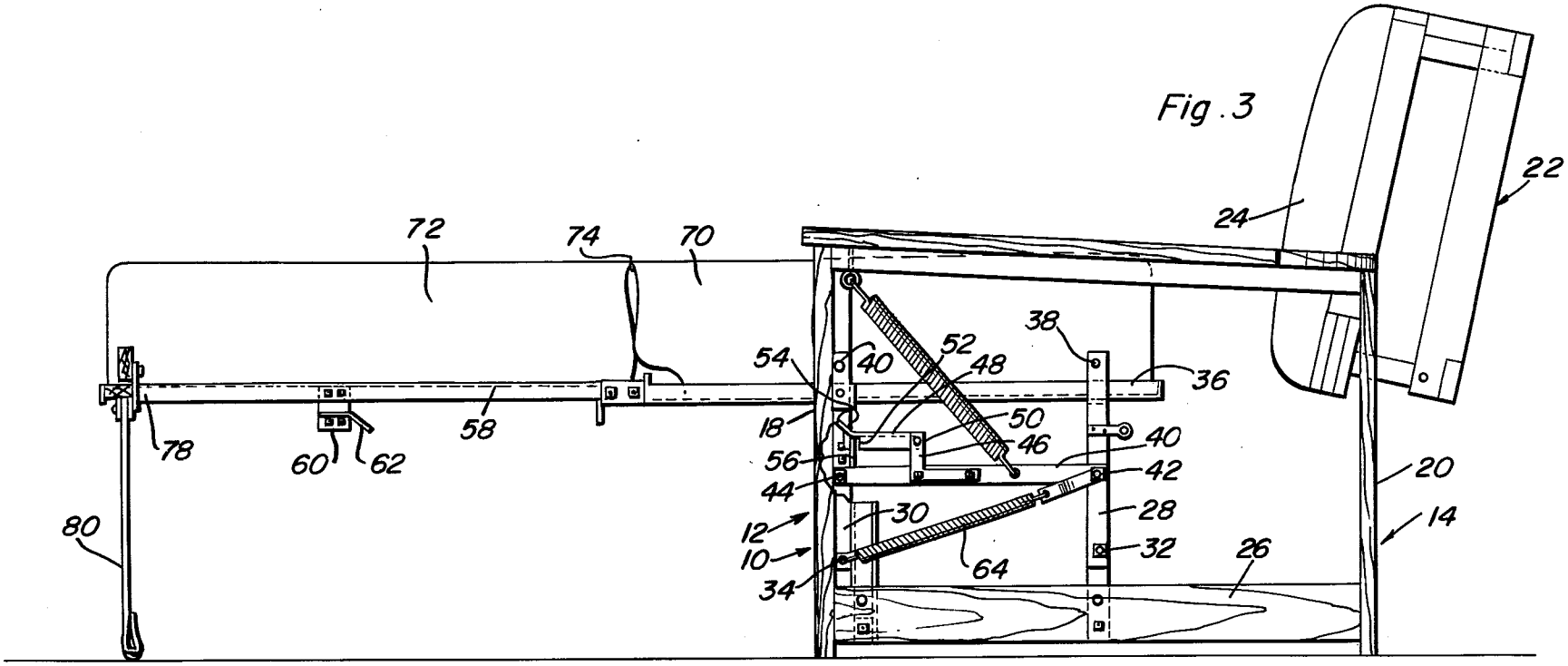
FIG. 3 is a side elevational view similar to FIG. 2 but with the various structural members of the invention in a bed defining position.
Figure 6:
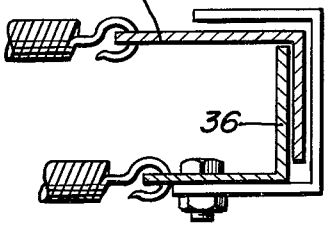
FIG. 6 is an enlarged fragmentary transverse vertial sectional view illustrating the manner in which the two seat frame sections of the invention are supported relative to each other for front to rear sliding movement of the upper seat frame supporting section relative to the lower seat frame supporting section.

A pair of expansion springs 64 are connected between the pivot axes defining fastening members 34 and 42 and swung to over center positions such as those illustrated in FIG. 2 when the support arms 28 are swung to their fully lowered positions, the expansion springs 64 thereby tending to maintain the frames 36 and 54 in the lowered positions. However, a second pair of expansion springs 66 are connected between the mid-portions of the stabilizing links 40 and the upper forward corner portions of the portions 14 and 16 of the frame 12. The springs 66 comprise counterbalance springs and assist in raising the frames 36 and 58 toward their upper positions after the center positions of the springs 64 have been passed.

A pair of seat cushions 70 and 72 are provided and are foldably joined as at 74 whereby the cushions 70 and 72 may be folded to superposed positions such as those illustrated in FIG. 2. When the sofa bed 10 is to be utilized as a sofa, the cushion 72 rests upon the upper seat supporting frame 58 and the cushion 70 has its rear marginal edge portion thereof swung upwardly and rearwardly from the position thereof illustrated in FIG. 3 until the cushion 70 is disposed in superposed relation over the cushion 72. Then, the seat cushion supporting frame 58 may be shifted rearwardly relative to the frame 36 from the position thereof illustrated in FIG. 3 of the drawings to a position with the second frame 58 disposed in superposed relation relative to the frame 36 after which further displacement of both the frames 36 and 58 will cause the latter to be lowered to the fully retracted positions illustrated in FIG. 2. It will also be noted that the upper rear marginal portion of the seat cushion 70 includes a corner edge recess 76 in which the lower marginal portion of the cushion 24 is received when the sofa bed 10 is in the sofa defining position.

Figure 5:
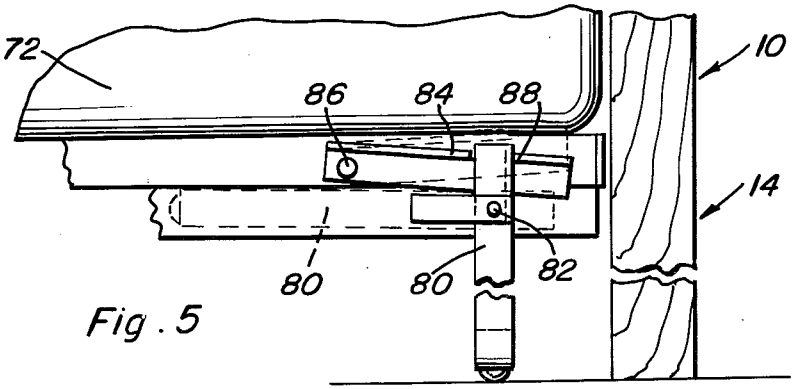
FIG. 5 is a fragmentary enlarged front elevational view of the right side or end of the sofa bed illustrating the manner in which one of the downwardly extendable legs utilized when the invention is in a bed defining position may be releasably retained in both a depending leg defining position and an upwardly retracted stored position.

With attention now invited more specifically to FIG. 5 of the drawings, the opposite side portions of the forward marginal portion 78 of the frame 58 include elongated leg members 80 pivotally secured to the frame 58 as at 82 and which are swingable about horizontal front to rear extending axes between the solid position thereof illustrated in FIG. 5 with the legs 70 in depending leg defining positions and the horizontal positions thereof illustrated in phantom lines in FIG. 5 with the legs 80 disposed in retracted positions. Pivoted latch members 84 are supported as at 86 at opposite sides of the forward marginal portion of the frame 58 and are operable to retain the legs 80 in both the depending operative position illustrated in solid lines in FIG. 5 and the raised inoperative positions illustrated in phantom lines in FIG. 5, the members 84 being notched as at 88 to receive the upper ends of the legs 80 when they are in their depending leg defining positions.

In order to limit forward displacement of the second frame 58 relative to the first frame 36, the rear marginal portion of the second frame 58 includes a depending flange abuttingly engageable with an upstanding flange carried by the forward marginal edge portion of the frame 36. Further, any suitable form of upholstery may be used on the sofa bed 10 and it will be noted that double seat cushions 70 and 72 are utilized by each person sitting on the sofa bed when the latter is in a sofa defining position and that when each person lying on the cushions 70 and 72 and having his weight distributed throughout a larger plan area utilizes only a single thickness of the cushions 70 and 72 when the sofa bed is in the bed defining position.

The foregoing is considered as illustrative only of the principles of the invention. Further, since numerous modifications and changes will readily occur to those skilled in the art, it is not desired to limit the invention to the exact construction and operation shown and described, an accordingly all suitable modifications and equivalents may be resorted to, falling within the scope of the invention.

What is claimed as new is as follows:

1. A convertible sofa bed including a main frame including upright side portions having front and rear ends, an upstanding backrest section supported from said frame, including a lower marginal portion and projecting upwardly above the rear ends of said opposite side portions, a pair of substantially parallel front and rear support arms disposed at opposite sides of said main frame and pivotally supported at a first pair of corresponding ends from lower portions of forward and intermediate portions of the corresponding side of said main frame for swinging about horizontal transverse axes between first substantially upright positions with the other pair of corresponding ends uppermost and second rearwardly projecting generally horizontal positions with said other pair of ends disposed rearmost, a first horizontal seat frame including front and rear marginal portions and opposite side portions to intermediate and rear portions of which the other pair of ends of the corresponding support arms are pivotally secured for swinging about horizontal transverse axes a second seat frame including front and rear marginal portions, means supporting said second frame from and in position overlying said first frame independent of direct connection of said second frame with said main frame side portions and for forward extending movement of said second frame relative to said first frame, after the latter has been elevated by swinging of said support arms to their upright positions, to an extended position with only the rear marginal portion of said second frame supported from the front marginal portion of said first frame, said second frame including downwardly extendable support leg means mounted from the front marginal portion thereof, and a pair of cushion sections overlying said first and second frames to form a bed mattress when said frames are forwardly extended and with said cushion overlying said second frame positionable, in superposed vertically stacking relation, on said first frame cushion when the second frame is to be rearwardly shifted relative to said first frame and the latter is to be swung rearwardly and downwardly to a position with said support arms in said second positions thereof and with the rear marginal portion of the uppermost stacked cushion section closely underlying the lower marginal portion of said backrest section, at least one of said front support arms and the corresponding side main frame portion front end including deactivatable coacting latch means deactively retaining said front support arms in said first positions thereof, said second seat frame being supported from said first seat frame for horizontal front to rear shifting relative thereto between its forwardly extending and superposed position relative thereto, said second seat frame including latch means deactivating means operative to automatically deactivate said latch means in response to shifting of said second seat frame from is forwardly displaced position toward its superposed relative to said first seat frame past an intermediate position.

2. The combination of claim 1 wherein said deactivating means is operative to maintain said latch means deactivated when said front support arms are in said first positions thereof until such time as said second frame is shifted past said intermediate position toward said extended position.

3. The combination of claim 1 wherein said sofa bed includes spring means connected between said frame and said support arms and disposed in over center position yieldingly resisting movement of said first seat frame upwardly from a lowered position with said support arms disposed in the second positions thereof.

4. The combination of claim 3 wherein said spring means are swingable past center portions thereof in response to initial movement of said support arms from said second positions thereof toward the first positions thereof and function to yieldingly bias said support toward the first positions thereof.

5. In combination, a main frame including opposite side portions each having front and rear ends, a horizontal first seat frame including front and rear marginal portions, mounting means supporting said first seat frame from said main frame for shifting between a first lowered position in vertical registry with said main frame and a second raised and forwardly displaced position with the front marginal portion of said first seat frame projecting appreciably forwardly of said main frame, a second seat frame including front and rear marginal portions, means supporting said second frame from said first seat frame independent of direct connection of said second frame with the said main frame and for shifting o of said second frame between a first retracted position superposed upon said first seat frame and a second forwardly extended position with substantially all but the rear marginal portion of said second seat frame projecting horizontally forwardly of said first seat frame, said mounting means and said main frame including deactivatable latch mean operative to retain said first seat frame in said second position, said second frame including latch means deactivating means operative to automatically deactivate said latch means upon shifting of said second seat frame rearwardly from said extended position toward said first position past a predetermined intermediate position between said extended and retracted positions.

6. The combination of claim 5 wherein said second seat frame includes downwardly extendable support leg means mounted from the front marginal portion thereof.

* * * * *